US005677676A

United States Patent [19]

Bell, Jr.

[11] Patent Number: 5,677,676

[45] Date of Patent: Oct. 14, 1997

[54] CRIME PREVENTION DEVICE FOR PREVENTING VIEWING OF AMBIENT CONDITIONS

[76] Inventor: Phillip Bell, Jr., 6711 Farmer Dr., Fort Washington, Md. 20744

[21] Appl. No.: 632,106

[22] Filed: Apr. 15, 1996

[51] Int. Cl.[6] ..... G08B 23/00

[52] U.S. Cl. ..... 340/573; 434/236; 482/3

[58] Field of Search ..... 434/112, 236, 434/307 R, 308, 365; 482/10, 3; 128/637, 639, 645, 733, 734; 340/573, 576, 575

[56] References Cited

U.S. PATENT DOCUMENTS

| | | | |
|---|---|---|---|
| 3,942,270 | 3/1976 | Hoyt et al. | 35/12 N |
| 4,283,177 | 8/1981 | Kron et al. | 434/59 |
| 4,665,928 | 5/1987 | Linial et al. | 482/1 |
| 4,867,442 | 9/1989 | Matthews | 272/93 |
| 4,972,177 | 11/1990 | Nolan | 340/573 |
| 5,308,246 | 5/1994 | Balocco | 434/236 |
| 5,315,289 | 5/1994 | Fuller et al. | 340/573 |

*Primary Examiner*—Jeffery Hofsass
*Assistant Examiner*—Anh La

[57] ABSTRACT

A crime prevention device including a housing adapted for positioning upon a face of a wearer over eyes thereof. An elastic band has opposing free ends secured to the housing for securement of the housing upon the face of the wearer. A plurality of pressure switches are disposed within the elastic band and an upper portion of the housing. A plurality of skin contacts are disposed within the upper portion of the inner surface of the housing between the plurality of pressure switches. A charger and transmitter is disposed within the housing. The charger and transmitter is electrically coupled with the plurality of skin contacts. A central processing unit is disposed in a location remote from the housing. The central processing unit cooperates with the plurality of skin contacts and the charger and transmitter. An alarm is disposed in a location remote from the housing. The alarm cooperates with the charger and transmitter.

5 Claims, 3 Drawing Sheets

CRIME PREVENTION DEVICE FOR PREVENTING VIEWING OF AMBIENT CONDITIONS

BACKGROUND OF THE INVENTION

1. Field of the Invention

The present invention relates to a crime prevention device and more particularly pertains to preventing viewing of ambient conditions by a wearer such that an electrical shock is imparted to a wearer in response to tampering with the device with a crime prevention device.

2. Description of the Prior Art

The use of vision training devices is known in the prior art. More specifically, vision training devices heretofore devised and utilized for the purpose of training vision of a wearer are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,308,246 to Balocco discloses a visualization training device with adjustable electro-optical shutter.

U.S. Pat. No. 4,283,177 to Kron et al. discloses a vision loss simulator.

U.S. Pat. No. 4,152,846 to Witt discloses a flight training method and apparatus.

U.S. Pat. No. 3,942,270 to Hoyt et al. discloses a simulation of visual blackout due to aircraft maneuvering.

U.S. Pat. No. 4,106,217 to Witt discloses a head mounted flight training apparatus.

U.S. Pat. No. 4,021,935 to Witt discloses a flight training hood.

While these devices fulfill their respective, particular objective and requirements, the aforementioned patents do not describe a crime prevention device for preventing viewing of ambient conditions by a wearer such that an electrical shock is imparted to a wearer in response to tampering with the device.

In this respect, the crime prevention device according to the present invention substantially departs from the conventional concepts and designs of the prior art, and in doing so provides an apparatus primarily developed for the purpose of preventing viewing of ambient conditions by a wearer such that an electrical shock is imparted to a wearer in response to tampering with the device.

Therefore, it can be appreciated that there exists a continuing need for new and improved crime prevention device which can be used for preventing viewing of ambient conditions by a wearer such that an electrical shock is imparted to a wearer in response to tampering with the device. In this regard, the present invention substantially fulfills this need.

SUMMARY OF THE INVENTION

In the view of the foregoing disadvantages inherent in the known types of vision training devices now present in the prior art, the present invention provides an improved crime prevention device. As such, the general purpose of the present invention, which will be described subsequently in greater detail, is to provide a new and improved crime prevention device and method which has all the advantages of the prior art and none of the disadvantages.

To attain this, the present invention essentially comprises a housing adapted for positioning upon a face of a wearer.

The housing is configured similar to a pair of goggles. The housing has an outer surface, an inner surface and a pair of compartments therebetween. The outer surface and the inner surface are comprised of a non-transparent material. The inner surface has side portions extending essentially orthogonally from end portions therefrom. The device includes an elastic band having opposing free ends secured to the side portions of the housing for securement of the housing upon the face of the wearer. A plurality of pressure switches are disposed within the elastic band and an upper portion of the inner surface of the housing. A plurality of skin contacts are disposed within the upper portion of the inner surface of the housing between the plurality of pressure switches. A battery is disposed within one of the pair of compartments of the housing. The battery is electrically coupled with the plurality of pressure switches. Charging and transmitting means are disposed within one of the pair of compartments opposed from the battery. The charging and transmitting means are electrically coupled with the battery and the plurality of skin contacts. A central processing unit is disposed in a location remote from the housing. The central processing unit cooperates with the plurality of skin contacts and the charging and transmitting means. An alarm is disposed in a location remote from the housing. The alarm cooperates with the charging and transmitting means.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved crime prevention device which has all the advantages of the prior art vision training devices and none of the disadvantages.

It is another object of the present invention to provide a new and improved crime prevention device which may be easily and efficiently manufactured and marketed.

It is a further object of the present invention to provide a new and improved crime prevention device which is of durable and reliable construction.

An even further object of the present invention is to provide a new and improved crime prevention device which is susceptible of a low cost of manufacture with regard to both materials and labor, and which accordingly is then susceptible of low prices of sale to the consuming public, thereby making such a crime prevention device economically available to the buying public.

Still yet another object of the present invention is to provide a new and improved crime prevention device which provides in the apparatuses and methods of the prior art some of the advantages thereof, while simultaneously overcoming some of the disadvantages normally associated therewith.

Even still another object of the present invention is to provide a new and improved crime prevention device for preventing viewing of ambient conditions by a wearer such that an electrical shock is imparted to a wearer in response to tampering with the device.

Lastly, it is an object of the present invention to provide a new and improved crime prevention device including a housing adapted for positioning upon a face of a wearer over eyes thereof. An elastic band has opposing free ends secured to the housing for securement of the housing upon the face of the wearer. A plurality of pressure switches are disposed within the elastic band and an upper portion of the housing. A plurality of skin contacts are disposed within the upper portion of the inner surface of the housing between the plurality of pressure switches. A battery is disposed within the housing. The battery is electrically coupled with the plurality of pressure switches. A charger and transmitter is disposed within the housing. The charger and transmitter is electrically coupled with the battery and the plurality of skin contacts. A central processing unit is disposed in a location remote from the housing. The central processing unit cooperates with the plurality of skin contacts and the charger and transmitter. An alarm is disposed in a location remote from the housing. The alarm cooperates with the charger and transmitter.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
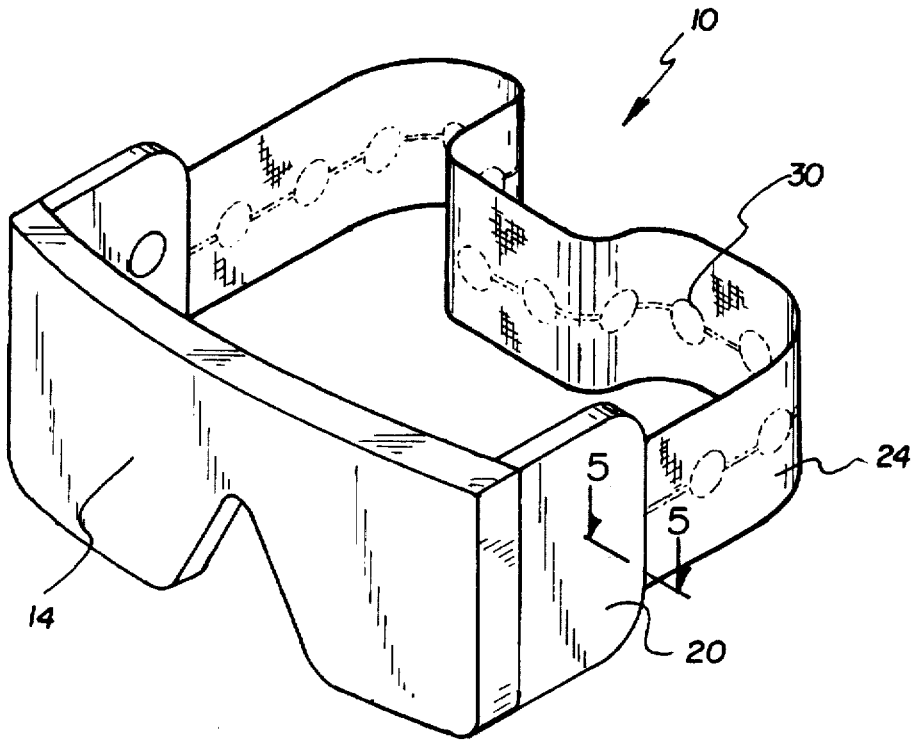
FIG. 1 is a perspective view of the preferred embodiment of the crime prevention device constructed in accordance with the principles of the present invention.
Figure 2:
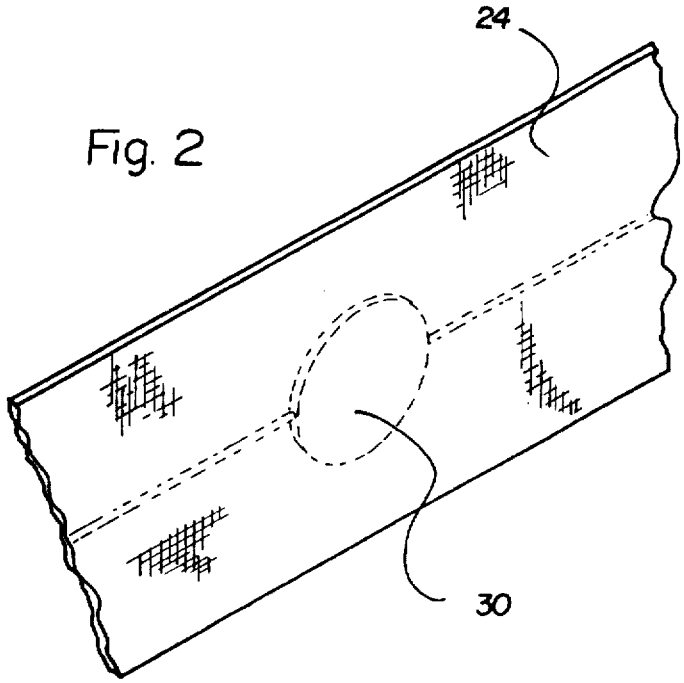
FIG. 2 is a perspective fragmentary view of the elastic strap of the present invention.
Figure 3:
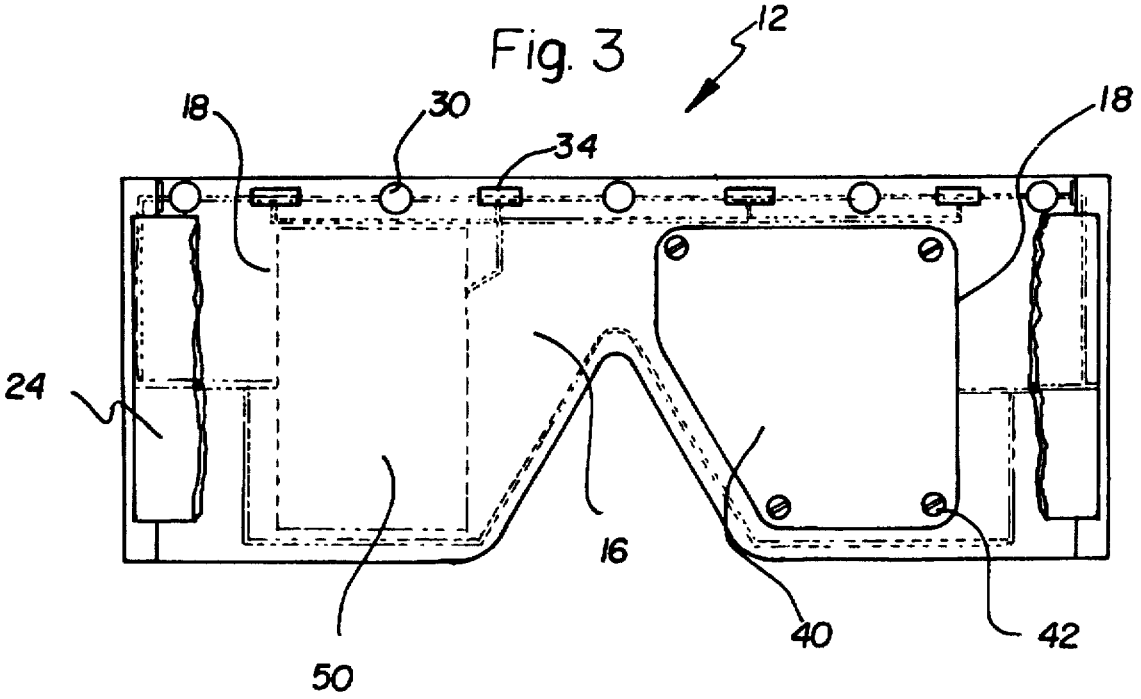
FIG. 3 is a rear elevation view of the housing of the present invention.
Figure 4:
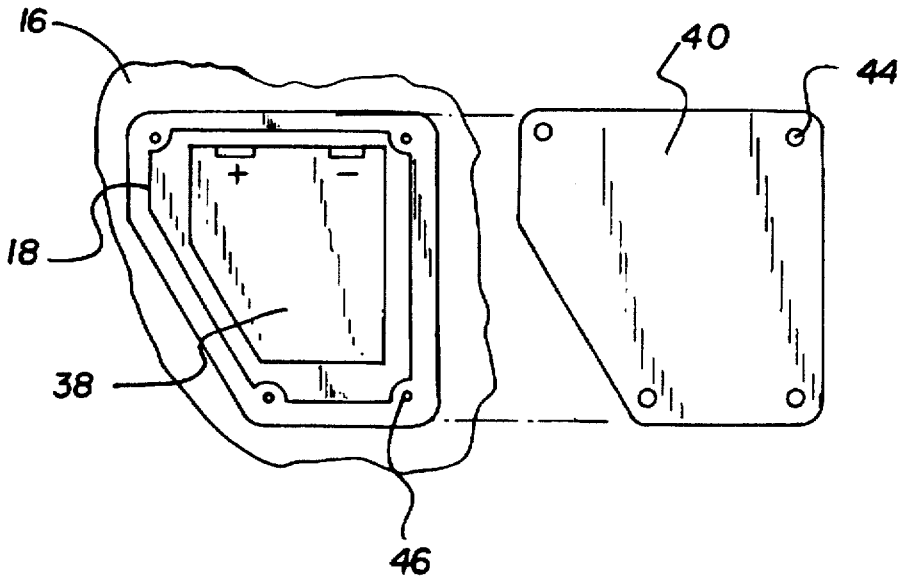
FIG. 4 is a front view of the battery chamber of the present invention.
Figure 5:
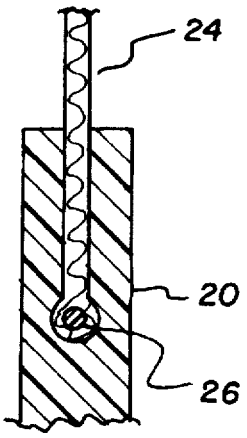
FIG. 5 is a cross-sectional view of the present invention as taken along line 5—5 of FIG. 1.
Figure 6:
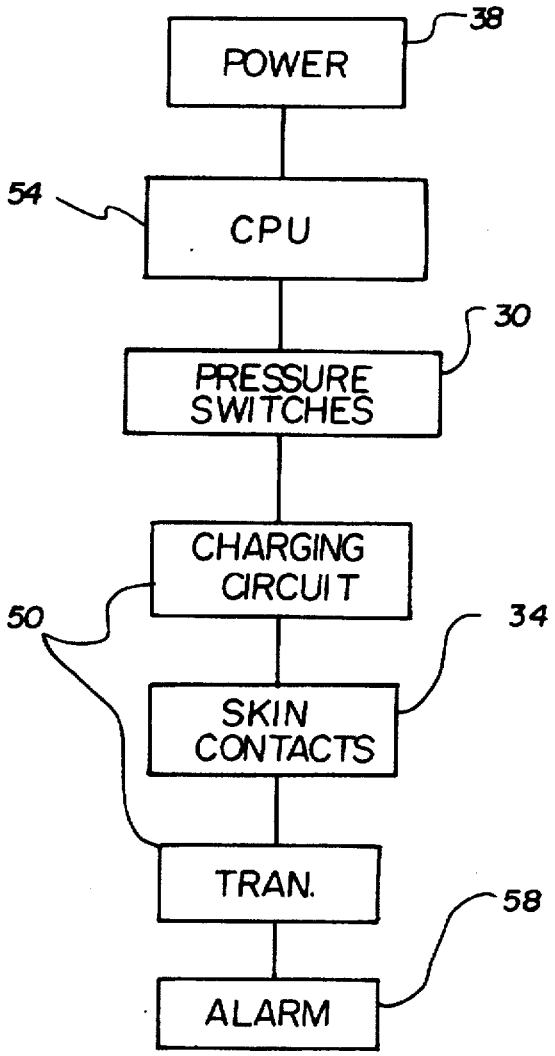
FIG. 6 is a schematic description of the present invention.

With reference now to the drawings, and in particular, to FIGS. 1–6 thereof, the preferred embodiment of the new and improved crime prevention device embodying the principles and concepts of the present invention and generally designated by the reference number 10 will be described.

Specifically, it will be noted in the various Figures that the device relates to a new and improved crime prevention device for preventing viewing of ambient conditions by a wearer such that an electrical shock is imparted to a wearer in response to tampering with the device. In its broadest context, the device consists of a housing, an elastic band, a plurality of pressure switches, a battery, charging and transmitting means, a central processing unit and an alarm. Such components are individually configured and correlated with respect to each other so as to attain the desired objective.

The device 10 includes a housing 12 adapted for positioning upon a face of a wearer. The housing 12 is configured similar to a pair of goggles. The size and configuration of the housing 12 will very to accommodate various sized wearer's. The housing 12 can be designed in various styles each having varying degrees of comfort. The housing 12 has an outer surface 14, an inner surface 16 and a pair of compartments 18 therebetween. The outer surface 14 and the inner surface 16 are comprised of a non-transparent material. The outer surface 14 and the inner surface 16 are positioned over the eyes of the wearer thereby preventing the wearer from seeing. The inner surface 16 has side portions 20 extending essentially orthogonally from end portions therefrom. When in use, the side portions 20 will extend along the side of the wearer's head. Note FIG. 1.

The device 10 includes an elastic band 24 having opposing free ends 26 secured to the side portions 20 of the housing 12 for securement of the housing 12 upon the face of the wearer. Note FIG. 5. The elastic band 24 is specifically designed to prevent adjustment. The length of the elastic band 24 will be specifically designed to a particular wearer's head size. Note FIGS. 1 and 2.

A plurality of pressure switches 30 are disposed within the elastic band 24 and an upper portion of the inner surface 16 of the housing 12. The pressure switches 30 are preferably of a circular diameter with individual pressure disposed around the housing 12 and the elastic band 24 in an equally spaced relationship. Note FIG. 2. The elastic band 24 should be of a length whereby each of the pressure switches 30 is in contact with the head of the wearer at all times.

A plurality of skin contacts 34 are disposed within the upper portion of the inner surface 16 of the housing 12 between the plurality of pressure switches 30. The skin contacts 34 are configured in a generally rectangular shape. Note FIG. 3. The skin contacts 34 will be in contact with the wearer's head at all times while the device 10 is secured thereto.

A battery 38 is disposed within one of the pair of compartments 18 of the housing 12. The battery 38 is electrically coupled with the plurality of pressure switches 30. A battery door 40 is disposed over the compartment to allow for easy access to the battery 38. The battery door 40 is secured to the housing 12 over the compartment 18 by four small screws 42 extending through four apertures 44 in opposing corners of the door 40, into four apertures 46 within the housing 12. Note FIG. 4.

Charging and transmitting means 50 are disposed within one of the pair of compartments 18 opposed from the battery 38. Note FIG. 3. The charging and transmitting means 50 are electrically coupled with the battery 38 and the plurality of skin contacts 34. The charging and transmitting means 50 receives power from the battery 38 and transmits the power to the skin contacts 34 whereby if one of the pressure switches 30 is removed from contacting the wearer's head, an electric charge will be sent through the skin contacts 34 onto the wearer.

A central processing unit 54 is disposed in a location remote from the housing 12. The central processing unit 54 cooperates with the plurality of skin contacts 34 and the charging and transmitting means 50 whereby the charge is delivered through the skin contacts 34 to the wearer after being signalled by the central processing unit 54.

An alarm 58 is disposed in a location remote from the housing 12. The alarm 58 cooperates with the charging and transmitting means 54. Once the charge has been delivered, the alarm 58 is activated to alert proper authorities that tampering with the device 10 has occurred. The alarm 58 is preferably situated in a police switchboard where a police officer can be dispatched to arrest the wearer.

The device 10 is essentially designed to blind it's wearer. A criminal who is required to wear such a device 10 would be rendered unable to see thereby unable to commit any type of crime. If the wearer attempts to remove the device 10, the alarm 58 is activated thereby dispatching a police officer to apprehend the violator. The device 10 could possibly reduce overpopulation in jails by limiting the activities of convicted criminals from acting out on any future crimes.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A crime prevention device for preventing viewing of ambient conditions by a wearer such that an electrical shock is imparted to a wearer in response to tampering with the device comprising, in combination:

a housing adapted for positioning upon a face of a wearer, the housing configured similar to a pair of goggles, the housing having an outer surface, an inner surface and a pair of compartments therebetween, the outer surface and the inner surface comprised of a non-transparent material, the inner surface having side portions extending essentially orthogonally from end portions therefrom;

an elastic band having opposing free ends secured to the side portions of the housing for securement of the housing upon the face of the wearer;

a plurality of pressure switches disposed within the elastic band and an upper portion of the inner surface of the housing;

a plurality of skin contacts disposed within the upper portion of the inner surface of the housing between the plurality of pressure switches;

a battery disposed within one of the pair of compartments of the housing, the battery being electrically coupled with the plurality of pressure switches;

charging and transmitting means disposed within one of the pair of compartments opposed from the battery, the charging and transmitting means being electrically coupled with the battery and the plurality of skin contacts;

a central processing unit disposed in a location remote from the housing, the central processing unit cooperating with the plurality of skin contacts and the charging and transmitting means;

an alarm disposed in a location remote from the housing, the alarm cooperating with the charging and transmitting means.

2. A crime prevention device comprising:

a housing adapted for positioning upon a face of a wearer over eyes thereof;

an elastic band having opposing free ends secured to the housing for securement of the housing upon the face of the wearer;

a plurality of pressure switches disposed within the elastic band and an upper portion of the housing;

a plurality of skin contacts disposed within the upper portion of the inner surface of the housing between the plurality of pressure switches;

a battery disposed within the housing, the battery being electrically coupled with the plurality of pressure switches;

charging and transmitting means disposed within the housing, the charging and transmitting means being electrically coupled with the battery and the plurality of skin contacts;

a central processing unit disposed in a location remote from the housing, the central processing unit cooperating with the plurality of skin contacts and the charging and transmitting means;

an alarm disposed in a location remote from the housing, the alarm cooperating with the charging and transmitting means.

3. The crime prevention device as set forth in claim 2 wherein the housing configured similar to a pair of goggles, the housing having an outer surface, an inner surface and a pair of compartments therebetween, the outer surface and the inner surface comprised of a non-transparent material, the inner surface having side portions extending essentially orthogonally from end portions therefrom for coupling with the free ends of the elastic band.

4. The crime prevention device as set forth in claim 3 wherein the battery is disposed within a first compartment of the housing.

5. The crime prevention device as set forth in claim 3 wherein the charging and transmitting means is disposed within a second compartment of the housing.

* * * * *